US011203020B2

(12) United States Patent
Burhorst et al.

(10) Patent No.: US 11,203,020 B2
(45) Date of Patent: Dec. 21, 2021

(54) COMMINUTING DEVICE

(71) Applicant: VOGELSANG GMBH & CO. KG, Essen (DE)

(72) Inventors: Torsten Burhorst, Essen (DE); Markus Kolbeck, Essen (DE)

(73) Assignee: VOGELSANG GMBH & CO. KG, Essen (DE)

( * ) Notice: Subject to any disclaimer, the term of this patent is extended or adjusted under 35 U.S.C. 154(b) by 130 days.

(21) Appl. No.: 16/484,307

(22) PCT Filed: Feb. 9, 2018

(86) PCT No.: PCT/EP2018/053270
§ 371 (c)(1),
(2) Date: Aug. 7, 2019

(87) PCT Pub. No.: WO2018/146247
PCT Pub. Date: Aug. 16, 2018

(65) Prior Publication Data

US 2019/0374953 A1 Dec. 12, 2019

(30) Foreign Application Priority Data

Feb. 9, 2017 (DE) ..... 202017100714.6

(51) Int. Cl.
*B02C 18/00* (2006.01)
*B02C 18/14* (2006.01)
(Continued)

(52) U.S. Cl.
CPC ..... *B02C 18/0092* (2013.01); *B02C 18/142* (2013.01); *B02C 18/2275* (2013.01);
(Continued)

(58) Field of Classification Search
CPC ..... B02C 18/142; B02C 18/0092; B02C 18/2275; B02C 2018/0069; B02C 23/08
(Continued)

(56) References Cited

U.S. PATENT DOCUMENTS 3,396,914 A * 8/1968 Liebman ..... B02C 18/0007 241/63
3,940,115 A 2/1976 Zipperer
(Continued)

FOREIGN PATENT DOCUMENTS

CN 103476503 12/2013
CN 104324787 2/2015
(Continued)

*Primary Examiner* — Faye Francis
(74) *Attorney, Agent, or Firm* — Price Heneveld LLP

(57) ABSTRACT

A comminuting device for solids-conducting liquids includes a housing with an inlet opening, an outlet opening, and a housing interior extending from the inlet opening to the outlet opening, a first comminuting shaft extending through the housing interior and arranged to rotate about a first comminuting axis. A second comminuting shaft extends through the housing interior and is arranged to rotate about a second comminuting axis. A screening device has a screening wall comprising a plurality of slots arranged in the housing interior adjacent to the first comminuting shaft. A clearing device has a plurality of clearing elements which can be moved relative to the screening wall along a movement path and which extend through the plurality of slots starting from a clearing shaft arranged on one side of the filter wall to at least one portion of the movement path.

25 Claims, 5 Drawing Sheets

(51) Int. Cl.
*B02C 18/22* (2006.01)
*B02C 23/08* (2006.01)
*B02C 18/16* (2006.01)

(52) U.S. Cl.
CPC ..... *B02C 23/08* (2013.01); *B02C 2018/0069* (2013.01); *B02C 2018/164* (2013.01); *B02C 2201/063* (2013.01)

(58) Field of Classification Search
USPC ..... 241/166, 236, 73
See application file for complete search history.

(56) References Cited

U.S. PATENT DOCUMENTS 5,562,257 A * 10/1996 Graveman ..... B02C 13/20 241/190
5,609,307 A * 3/1997 Rota ..... B02C 18/142 241/73
5,833,152 A 11/1998 Galanty
6,012,662 A 1/2000 Sullivan
6,109,551 A 8/2000 Sullivan
6,176,443 B1 * 1/2001 Boyd ..... B02C 18/0092 241/46.02
6,241,170 B1 * 6/2001 St. Clair ..... B02C 18/0007 241/166
RE37,349 E * 9/2001 Chambers, Sr. .... B02C 18/0092 241/46.02
6,332,984 B1 * 12/2001 Boyd ..... B02C 18/0092 210/497.1
6,938,845 B2 * 9/2005 Galanty ..... B02C 18/0092 241/166
7,198,212 B2 * 4/2007 Kato ..... B02C 18/0007 241/166
7,380,736 B2 * 6/2008 Nemedi ..... B02C 17/002 241/243
9,573,137 B2 * 2/2017 Van der Galien ..... B02C 23/16
10,130,952 B2 * 11/2018 Sabol ..... B02C 18/16
10,737,274 B2 * 8/2020 Schneider ..... B02C 18/2283
2008/0302890 A1 12/2008 Misawa et al.
2012/0037740 A1 2/2012 Galanty
2014/0332613 A1 * 11/2014 Zhou ..... B02C 18/142 241/166

FOREIGN PATENT DOCUMENTS

CN 204816753 12/2015
DE 1819645 10/1960
DE 1284267 11/1968
DE 2139497 2/1973
DE 7234578 2/1973
EP 2613884 B1 9/2011
EP 2586531 5/2013
EP 2613884 7/2013
JP 1988077555 4/1988
JP 2002263516 9/2002
JP 2017023937 2/2017
KR 101636540 7/2016
WO 2010053800 9/2010

* cited by examiner

COMMINUTING DEVICE

CROSS-REFERENCE TO FOREIGN PRIORITY APPLICATION

The present application claims the benefit under 35 U.S.C. §§ 119(b), 119(e), 120, and/or 365(c) of PCT/EP2018/053270 filed Feb. 9, 2018, which claims priority to German Application No. 202017100714.6 filed Feb. 9, 2017.

FIELD OF THE INVENTION

The invention relates to a comminuting device for solids-conducting liquids comprising a housing with an inlet opening, an outlet opening and a housing interior which extends from the inlet opening to the outlet opening, a first comminuting shaft which extends through the housing interior and which is arranged so as to rotate about a first comminuting axis and to which a plurality of first comminuting cutting elements spaced apart axially along the first comminuting axis is fastened, a second comminuting shaft which extends through the housing interior and which is arranged so as to rotate about a second comminuting axis and to which a plurality of second comminuting cutting elements spaced apart axially along the second comminuting axis is fastened, a drive device for driving the first and second comminuting cutting shaft in a rotational movement.

BACKGROUND OF THE INVENTION

Comminuting devices of the aforementioned kind are used to treat liquids containing solids in such a manner that the solids are comminuted and after leaving the outlet opening of the comminuting device the solids contained in the liquid no longer exceed a maximum size. The comminution of the solids in this case typically occurs due to shearing and breaking forces which act on the solids when they pass between the comminuting cutting elements.

The comminuting efficiency of comminuting devices of this kind crucially depends on slots and free spaces which result for the passage of the liquid being minimized in such a manner that solids above a certain size cannot get from the inlet opening to the outlet opening without a comminuting effect being exerted on these solids. The consequence of this requirement is that when a high degree of fineness and a small size is sought after for the solids emerging from the outlet opening, the cross section remaining for the liquid flow through the comminuting device is small and the comminuting device therefore produces a high flow resistance. In many applications, however, comminuting devices are precisely used for installation in the flow supply to a pump, so that damage to the pump caused by solids above a given size is thereby reliably prevented. Both in the case of self-priming pumps and also non-self-priming pumps, a greater flow resistance in the supply is disadvantageous to the pumping action and efforts are therefore made to configure the flow in the supply to the pump with as little resistance as possible.

In principle it is known in the art for the problem of flow resistance in comminuting devices of this kind to be solved by the distance between the two comminuting shafts being increased, the length of the comminuting shafts being increased, and the size of the comminuting cutting elements or the diameter of comminuting cutting elements configured as a disc with circumferentially arranged cutting teeth being increased. Although these measures may solve the problem of increased flow resistance, they lead to comminuting devices which take up a lot of installation space, are heavy, and generate additional production costs.

SUMMARY OF THE INVENTION

The problem addressed by the invention is that of providing a comminuting device which avoids disadvantages of this kind and which achieves reliable comminution with a smaller flow resistance, both in the case of liquid flows with a small proportion of solids and a high volume throughput and in the case of liquid flows with a high proportion of solids.

This problem is solved according to the invention with a comminuting device of the kind described above which is furthermore equipped with a first screening device having a first screening wall exhibiting a plurality of slots which is arranged in the housing interior adjacent to the first comminuting shaft, and a first clearing device with a plurality of clearing elements which can be moved relative to the screening wall along a movement path and which extend through the plurality of slots starting from a first clearing shaft arranged on one side of the first filter wall to at least one portion of the movement path.

According to the invention, a screening device is provided which has a screening wall. The solids-conducting liquid can flow through this screening wall from the inlet opening to the outlet opening, wherein the screening effect means that solids above a certain size, namely above the screen mesh width or slot width, are prevented from passing through the screening wall. A reduction in flow resistance through the screening wall is therefore achieved by the comminuting device, in that additional flow paths are provided for the liquid. Solids above a particular size are thereby prevented from being able to flow through the comminuting device along these flow paths.

In order to keep the screening wall with the slots contained therein permeable, a clearing device is furthermore provided according to the invention. The clearing device comprises a plurality of movable clearing elements which can be moved relative to the screening wall. The clearing elements extend on at least one section of their movement path through the slots in the screening wall and are thereby able to clear solids which are partially or completely blocking the slots and thereby keep the slots unobstructed.

The clearing device may, in principle, be actively or passively driven, for example the movement of the clearing elements can be effected by the flow action of the liquid through the comminuting device, wherein this is achieved where appropriate by corresponding flow-conducting elements which are coupled to the clearing device. Furthermore, the clearing device can be coupled to the first and/or second comminuting shaft and driven by the coupling, which brings about a synchronous movement of the clearing elements with the comminuting cutting elements.

According to a first preferred embodiment, the comminuting device can be developed by a clearing drive device which is coupled to the first clearing shaft and sets the first clearing shaft in rotation. According to this development, a clearing drive device is provided, such as an electric motor, a hydraulic motor or the like, for example, with which the clearing shaft to which the clearing elements are fastened is set in rotation, so that the clearing elements describe a circular path as the movement path and this circular path extends at least sectionally through the slots. It should be understood that each clearing element follows its own movement path in principle, for example each clearing element is assigned to a slot in the screening wall and clears this or, however, that a plurality of clearing elements of this kind are provided to clear a slot and comb through said slot consecutively on a matching or deviating movement path.

According to a further preferred embodiment, it is provided that the clearing drive device comprises hydrodynamically acting fluid-conducting elements which are arranged in the interior and flowed through by the liquid flow passing through the interior or an electrically, pneumatically or hydraulically driven motor. According to this embodiment, the clearing drive device is configured by fluid-conducting elements such as guide vanes which have been flowed against by the liquid flow through the interior and are set in motion, as a result of which the first clearing shaft is caused to rotate. Alternatively, a motor may be provided which generates movement of the clearing elements irrespective of the through-flow of the interior. This motor may, in particular, be arranged outside the inner space so as to avoid loading the motor with liquid.

According to a further preferred embodiment, it is provided that the first and second comminuting shafts extend between the first screening device and a second screening device with a second screening wall exhibiting a plurality of slots and a second clearing device with a plurality of clearing elements which extend through the plurality of slots starting from a second clearing shaft arranged on one side of the second screening wall. According to this embodiment, a total of two screening devices are provided which are preferably of the same design and are mirror-symmetrical to a plane which extends centrally between the two comminuting shafts in the through-flow direction and parallel to the comminuting shafts through the interior. Alternatively, the second screening device may, however, also be configured with a different geometry, a different layout or a different clearing device as the first screening device. In this embodiment which has two screening devices, the first and second comminuting shafts are arranged between the two screening devices, so that the liquid flowing through the interior is able to take a total of three general liquid flow paths through the interior, one liquid path goes through the first screening device, one liquid path goes through the second screening device and one liquid path goes through the region of the two comminuting shafts. The advantage of these two arrangements lies in the fact that a flow profile which is homogeneous overall is achieved at the outlet, that furthermore, starting from both sides, solids can be conducted through the first and second clearing device in the direction of the comminuting shafts when the slots in the first and second clearing device are cleared. To this end, it is particularly advantageous for the movement of the clearing elements to run inwards from the outside, in other words directed at the comminuting shafts in the portion in which the clearing elements extend through the slots in the first or second screening wall.

It is furthermore preferably provided in this case for the second clearing shaft to be set in rotation by the first clearing drive device or for the second clearing shaft to be coupled to a second clearing drive device which is configured corresponding to the first clearing drive device and set in rotation. According to this embodiment, the second clearing device exhibits either a separate clearing drive device which may likewise be configured like the previously explained first clearing drive device. Alternatively, the second clearing shaft may be coupled to the first clearing drive device and moved by the first clearing drive device, in particular set in rotation, which causes a synchronous movement and synchronous drive of the first and second clearing shaft.

According to a further preferred embodiment, it is provided that the axial space between two axially adjacent first comminuting elements is at least the same size, at least twice as large, at least five times as large, or at least ten times as large, as the ball passage of the slots. According to this embodiment, the axial spacing between two axially adjacent first comminuting elements is at least twice as large, in particular at least five times as large, preferably at least ten times as large, as the ball passage of the slots. According to this embodiment, the axial distance between two adjacent comminuting elements in the axial direction is in a given minimum size ratio to the ball passage of the slots in the first or second screening wall. The ball passage in this case must be understood to mean a dimension which describes the diameter of a circular ball which passes straight through the slots in the screening wall, in other words the maximum diameter of a ball which can pass through a slot in the screening wall. Through the ratio defined in this way, it is firstly ensured that solids above a given size can neither pass through the screening wall nor through the comminuting shafts through the interior from the inlet opening to the outlet opening. It should be understood in this case that the distance between two comminuting elements is the axial dimension of the free space in relation to the rotational axis of the comminuting shaft between the one comminuting element and the other comminuting element, so for example in the case of disc-shaped comminuting elements with teeth on the circumference, the axial distance between the end faces pointing to one another of two axially adjacent disc-shaped cutting elements of a comminuting shaft. It should be understood that during operation a cutting element of the second comminuting shaft reaches inside the intermediate space configured in this manner, which is formed by the axial spacing from two comminuting elements of the first comminuting shaft, and thereby reduces the passage cross section. This means that in the region in which the cutting elements of the first and second comminuting shaft mesh with one another, only solids with a very small dimension can pass through. In the regions which are external for this purpose, in which the cutting elements do not mesh with one another, a larger cross section is on the other hand provided for the passage of solids. In principle, the cutting elements may perform a movement which is directed against the flow direction of the solids in this external region, in other words, for example, of such a kind that the first and second comminution shaft perform a rotation in opposite directions to one another which is directed in the flow direction of the liquid from the inlet opening to the outlet opening in the internal circumferential region in which the cutting elements mesh with one another.

In this case, it should be understood in principle that the free spaces between the cutting elements in the external regions, in which the first and second cutting elements do not mesh with one another, can also be filled partially or completely by fixed elements which are fastened to the housing of the comminuting device, with which the cutting elements then mesh accordingly, in order to prevent the passage of solids above a given size or those lying in this external region overall.

It is still further preferable for the first and second comminuting shaft to be driven in rotational directions opposing one another and for the first and second comminuting axis preferably to run parallel to, and be spaced apart from, one another. According to this embodiment, the two comminuting shafts extend parallel to one another, so that the rotational axes of the two comminuting shafts are at the same distance from one another everywhere. This design may, in particular, produce a good and homogeneous comminuting output over the entire length of the comminuting shafts.

According to a further preferred embodiment, it is provided that the clearing elements comprise a plurality of curved clearing fingers. According to this embodiment, the clearing elements are formed by clearing fingers, which should be understood to mean rod-shaped or wall-shaped elements which extend radially outwards starting from the clearing shaft. The clearing fingers in this case are curved, which means they may exhibit a radial, a tangential, possibly also an axial, directional component in relation to their extension direction starting from the clearing shaft. In particular, a change in extension direction over the length of the clearing fingers is achieved by the curvature, which is advantageous to an efficient clearing of solids in order to achieve a carrier effect; on the other hand, it is possible to prevent the clearing elements from breaking under an excessive load, for example due to a solid being jammed in a slot in a screening wall, since a curved profile means that elastic deflection of the clearing elements is better facilitated.

According to a further preferred embodiment, it is provided that the curvature of the clearing fingers forms a convex front side and/or a concave rear side of each clearing finger, wherein the front side runs ahead of the rear side in relation to the movement direction of the clearing elements. According to this embodiment, the clearing elements have a backwardly directed curvature in relation to the movement direction, so that solids which are in the slots are pressed radially outwards by the clearing fingers and the clearing fingers can yield radially inwards during a deformation acting in the tangential direction due to contact with the solids during the movement. In the case of applications in which low-strength solids are contained in the liquid flow, this may bring about an effective clearance of the slots in that the clearing fingers could also exert a shearing action with the comminuting action. The curvature profile of the clearing fingers makes it easier for the clearing fingers to go round when there are solids trapped in the slots and thereby avoid damage to said clearing fingers through breakage or plastic deformation, in that the clearing elements initially make contact with any trapped solids element with the convex side and can then be elastically deformed away from this. In other applications, a curvature converse to this is preferred, in which the clearing fingers consequently form a concave front side and a convex rear side.

It is furthermore preferable for the first clearing elements to be configured for a rotational movement about a first spatial axis. A rotational movement of this kind is preferred for the driving method of the clearing shaft and can bring about efficient clearing of the slots by the clearing elements, in that the clearing elements move on a circular path about the rotational axis of the clearing shaft.

It is still further preferable for the first screening wall to have a curved screening wall surface which preferably constitutes a cylinder surface about the first clearing axis, at least in one screening wall portion. Through the embodiment of the first screening wall with a curved screening wall surface, a diversion of solids along the screening wall is on the one hand encouraged and, consequently, a deposition of solids, as would take place in the case of a planar screening wall surface, for example, prevented. In particular, the curvature of the screening wall surface can be formed in such a manner that the inlet opening in the screening wall facing the inlet opening is convexly curved, so that a deposition and collection of solids on the screening wall is prevented due to the possibility of solids slipping away along the convexly curved surface. In particular, the embodiment with a convex screening wall surface allows the clearing elements to completely pass through the slots during movement on a circular path and consequently achieve a clearing action at each point of the slot. This may, in particular, be achieved through a cylindrical geometry of the screening wall.

It is still further preferred for the first clearing elements to comprise a plurality of first clearing rakes with a plurality of clearing elements and for the clearing rakes to be fastened about a clearing shaft base body extending along a clearing axis. This embodiment combines in each case a plurality of clearing elements in the form of a clearing rake which therefore represents a component that can be replaced if damaged and can be produced in manufacturing terms such that the spacing of the clearing elements matches the spacing of the slots and, consequently, a high degree of precision is achieved in the movement of the clearing elements relative to the slots. A fork-shaped or rake-shaped embodiment is preferred as the clearing rake in this case, in which the clearing elements extend from a web connecting the clearing elements to a base.

It is still further preferred for at least two of the clearing rakes to be fastened to the clearing shaft base body in such a manner that the clearing elements of the one clearing rake extend at an angle about the clearing axis to the clearing rakes of the second clearing rake. In this embodiment, two or more clearing rakes are provided and fastened to a clearing shaft, wherein these clearing rakes are at an angle to one another. This embodiment is particularly preferred because in this way not all slots are passed through by the clearing elements simultaneously and a high torque such as would occur at a rotational angle of the clearing shaft if this passage through the slots were to take place by all clearing elements simultaneously is avoided and instead the clearing elements of the different clearing rakes pass through the slots with an angular offset and therefore distribute, and reduce as a whole, the torque occurring through contact with solids in the slots.

It is still further preferred in this case for a number N of clearing rakes to be fastened to the clearing shaft base body and for two of the clearing rakes in each case to be oriented at an angle of 360°/N to one another. This division means that the clearing rakes are distributed uniformly in relation to their angular spacing over the entire periphery of the clearing shaft and the torques occurring through the contact of clearing elements with solids are thereby substantially reduced and distributed over the entire rotational angle of the clearing shaft.

It is still further preferable for the clearing elements to be fastened to a clearing shaft basic body and for at least two clearing elements, preferably a third or half of the clearing elements, in particular all clearing elements, to extend at a different angle from one another from the clearing shaft base body. According to this embodiment, either all clearing elements are arranged at a different angle to one another, so that no two clearing elements run parallel to one another in relation to the extension angle about the clearing axis. In other embodiments, it may be provided that two clearing elements run at parallel angles to one another in each case, in other words a paired arrangement with offset of the clearing element pairs occurs, or, however, three, four or even more clearing elements extend at parallel angles from the clearing shaft, the respective pairs, triples, etc. then stand at an angle to one another, however.

BRIEF DESCRIPTION OF THE DRAWINGS

A preferred embodiment of the invention is explained below with the help of the attached figures. The following figures show the preferred embodiment of the comminuting device according to the invention in different views and perspectives. In the figures.

DETAILED DESCRIPTION OF THE EMBODIMENTS

Figure 1:
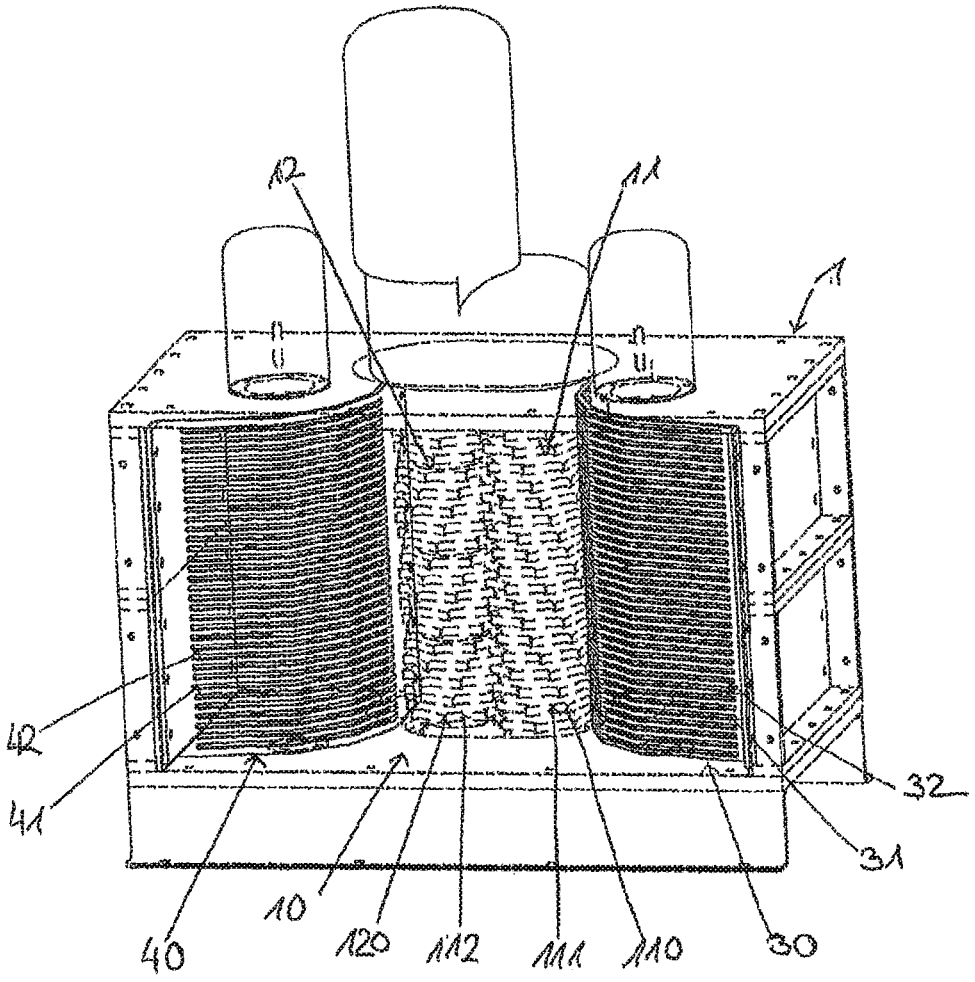
FIG. 1 is a perspective side view of a housing interior of an inventive comminuting device according to a preferred embodiment.

FIG. 1 shows a housing interior 10 of a comminuting device according to the invention.

The comminuting device has a first comminuting shaft 11 and a second comminuting shaft 12 mounted rotatably within a housing 1 in the housing interior 10. The first comminuting shaft 11 and the second comminuting shaft 12 have a plurality of comminuting cutting elements 110, 120 which are spaced axially on cutting discs 111, 112 and along a first or a second comminuting axis. Both the first comminuting shaft 11 and the second comminuting shaft 12 are made up of multiple cutting discs 111, 112. The housing interior 10 has a comminuting space which comprises an inlet and an outlet opening through which solids, or liquids containing solids, can be fed to the comminuting space or can be removed therefrom. The comminuting shafts 11, 12 extend into the comminuting space.

The two comminuting shafts 11, 12 rotate at different speeds, so that during each revolution different comminuting cutting elements 110, 120 of adjacent cutting discs 111, 112 of the two comminuting shafts 11, 12 come into engagement with one another and a shearing action is achieved between the comminuting cutting elements.

In a gear chamber, a transmission is arranged which comprises two gearwheels with a different number of teeth which are fastened straight onto the comminuting shafts 11, 12 in a torque-resistant manner and mesh with one another. In this way, a rotational movement in the opposite direction of the two comminuting shafts 11, 12 is produced, said shafts running at different rotational speeds. One of the two comminuting shafts 11 or 12 is fed out of the comminuting space and can be set in rotation by means of a drive motor. This rotation is transmitted by the transmission to the other comminuting shaft 11, 12. In this way, the first comminuting shaft 11 rotates about a first comminuting axis and the second comminuting shaft 12 in an opposing rotational direction about a second comminuting axis. The first comminuting axis and the second comminuting axis run parallel to, and spaced apart from, one another.

On the periphery of each cutting disc 111, 112 there are 8 comminuting cutting elements 110, 120 distributed uniformly in the circumferential direction. The comminuting cutting elements 110, 120 form screw lines of a thread with a steep pitch along the circumference of each comminuting shaft 11, 12. The comminuting cutting elements of a comminuting shaft form a left-handed thread; the comminuting cutting elements of the other comminuting shaft form a right-handed thread.

Adjacent to the first comminuting shaft 11 is arranged a first screening device 30. The first screening device 30 comprises a first screening wall 31 which has a curved surface and a plurality of slots 32. Similarly to this, there is a second screening device 40 adjacent to the second comminuting shaft 12. The second screening device 40 comprises a second screening wall 41 which has a curved surface and a plurality of slots 42. The curvatures of the first and second screening wall 31, 41 form a concave and a convex side. The convex side is formed on the inlet side and the concave side on the outlet side. In this way, a cylinder surface about the respective rotational axis represents the comminuting shaft at least in a screening wall portion of the first screening wall 31 or the second screening wall 41.

Figure 2:
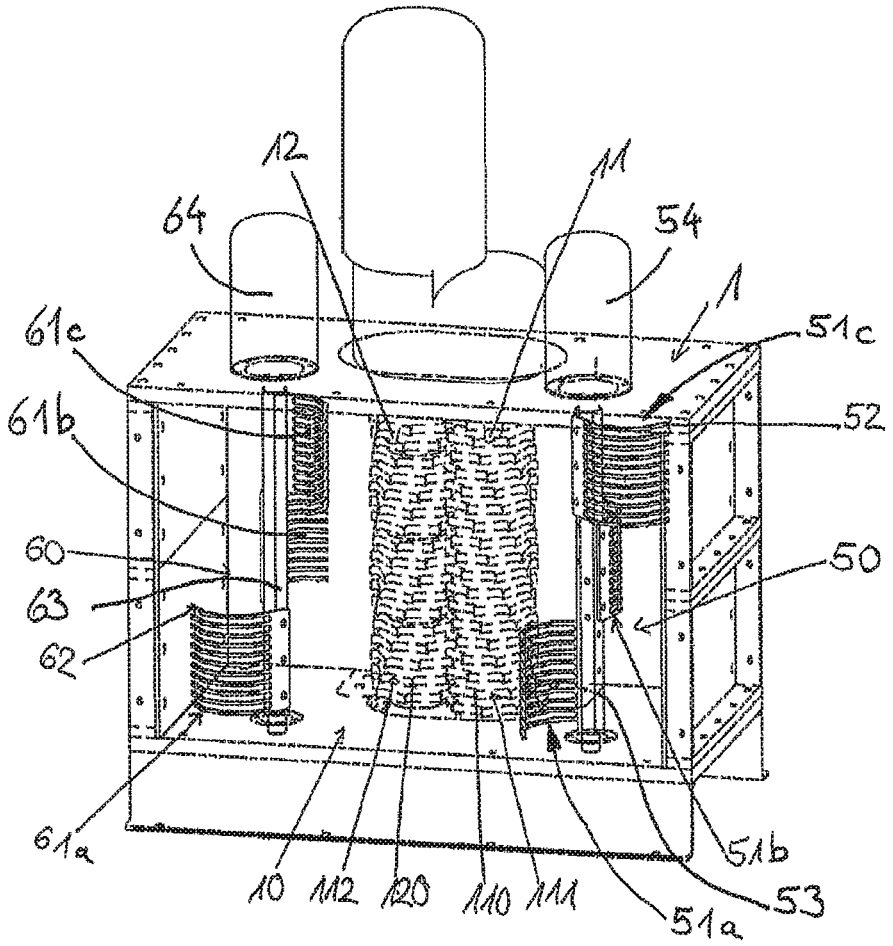
FIG. 2 is a perspective side view of a comminuting device according to the invention with the screening devices according to the preferred embodiment concealed.

FIG. 2 shows a housing interior 10 of a comminuting device according to the invention with the screening devices 30, 40 hidden. A first clearing device 50 is configured adjacent to the first comminuting shaft 11. The first clearing device 50 comprises three clearing rakes 51*a-c* which are fastened to a first clearing shaft base body 53. Each clearing rake comprises a plurality of curved clearing elements 52 in the form of curved clearing fingers. Similarly to this, there is a second clearing device 60 adjacent to the second comminuting shaft 12. The second clearing device 60 comprises three clearing rakes 61*a-c* which are fastened to a second clearing shaft base body 63. Likewise, a clearing rake comprises a plurality of curved clearing elements 52 in the form of curved clearing fingers. The clearing shaft base body of the first clearing device 50 is coupled to a clearing drive device, in order to set the first clearing shaft in rotation. The clearing shaft base body of the second clearing device 60 is set in rotation by a second clearing drive device 64.

The curvatures of the clearing elements 52, 62 form a convex front side and a concave rear side. The convex front side runs ahead of the rear side in relation to the movement direction of the clearing elements 52, 62. The clearing elements 52, 62 are configured for a rotational movement about a respective clearing axis.

The clearing rakes 51*a-c*, 61*a-c* are fastened to the clearing shaft base body extending along a clearing axis. In FIG. 2 the clearing rakes 51*a-c* of the first clearing device 50 are fastened to the first clearing shaft base body 53 in such a manner that the clearing elements 52 of the first clearing rake 51*a* extend at an angle of 120° to the clearing elements of the second clearing rake 51*b* and at an angle of 120° to the clearing elements of the third clearing rake 51*c*. Similarly to this, the clearing rakes 61 of the second clearing device 60 are fastened to the respective second clearing shaft base body 63 in such a manner that the clearing elements 62 of the first clearing rake 61*a* extend at an angle to the clearing elements of the second clearing rake 61*b* or else at an angle to the clearing elements of the third clearing rake 61*c*. The clearing rakes of the clearing elements 52, 62 therefore extend at different angles to one another from the respective clearing shaft base body.

Figure 3:
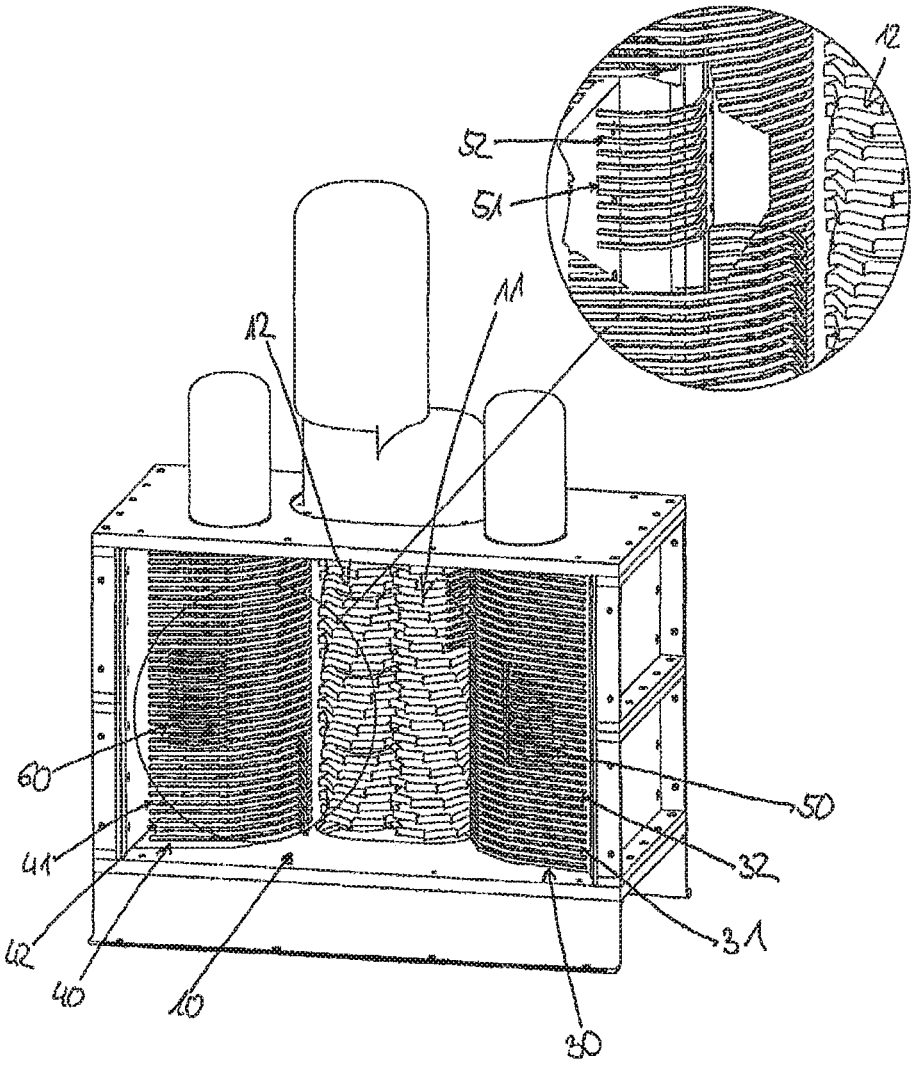
FIG. 3 is a perspective side view of a housing interior of a comminuting device according to the invention with a first screening device and a second screening device and also a first clearing device and a second clearing device according to the preferred embodiment.

FIG. 3 shows a housing interior 10 of a comminuting device according to the invention with a first screening device 30 and a second screening device 40 and also a first clearing device 50 and a second clearing device 60. The screening devices 30, 40 each with a screening wall 31, 41 exhibit a plurality of slots 32, 42. The first and second comminuting shaft 11, 12 is formed between the first screening device 30 and the second screening device 40. The first clearing device 50 comprises three clearing rakes 51*a-c* with a plurality of clearing elements 52 which extends, starting from a first clearing shaft arranged on a downstream side of the first screening wall 31, through the plurality of slots 32. Similarly to this, the second clearing device comprises three clearing rakes 61*a-c* with a plurality of clearing elements 62 which extends, starting from a second clearing shaft arranged on a downstream side of the second screening wall 41, through the plurality of slots 42. The curved clearing elements or clearing fingers 52, 62 run through the respective slots 32, 42 in the respective screening device 30, 40. When the clearing fingers 52, 62 emerge from the respective screening device 30, 40 from the inside outwards, foreign substances are actively conveyed outwards to the screening device 30, 40 in the direction of the first comminuting shaft 11 and second comminuting shaft 12. The width of the clearing fingers 52, 62 is adjusted to the slot width and guarantees continuous cleaning of the slots 32, 42 in the screening device 30, 40 from the inside outwards. The screening device 30, 40 is freely accessible on the outlet side. The clearing fingers 52, 62 are configured in such a manner that they run through the slots 32, 42 in a contact-free manner.

Figure 4A:
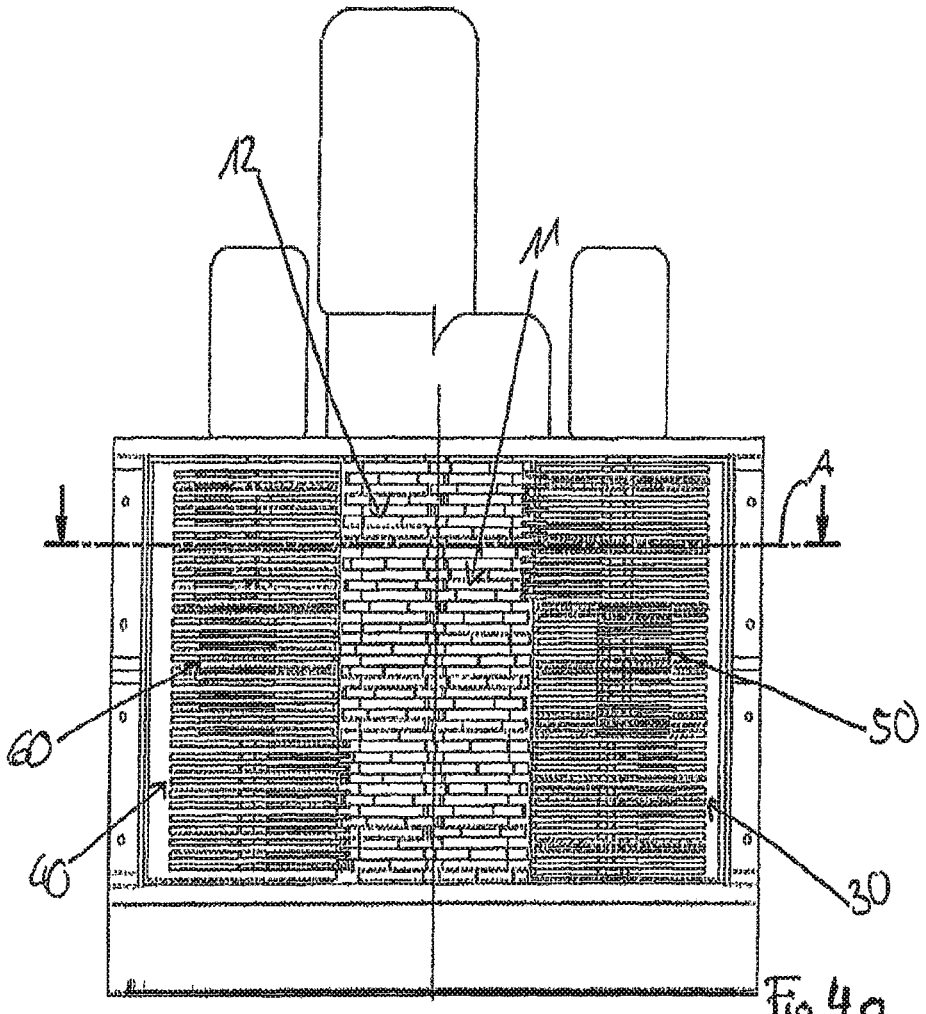
FIG. 4*a* is a side view of a housing interior of an inventive comminuting device according to the preferred embodiment.
Figure 4B:
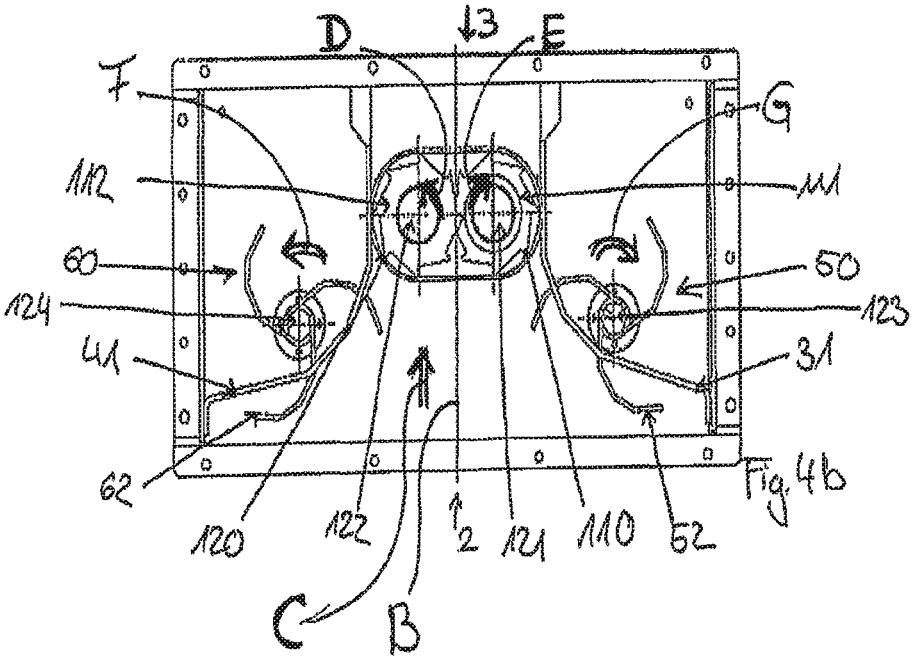
FIG. 4*b* is a sectional plan view of a comminuting device according to the invention along the line shown in FIG. 4*a* with a first screening device and a second screening device and also a first clearing device and a second clearing device according to the preferred embodiment.

FIG. 4*a* shows a side view of FIG. 3. FIG. 4*b* shows a plan view of the comminuting device according to the invention along line A in FIG. 4*a*. The plan view shows a first comminuting shaft 11 and a second comminuting shaft 12, a first screening device 30 and a second screening device 40, and also a first clearing device 50 and a second clearing device 60.

FIG. 4*b* shows two cutting discs 111, 112 of the inventive design. As can be seen, both cutting discs 111, 112 have an axial longitudinal bore 121, 122 which is used so that the cutting discs 111, 112 can be slid onto the respective comminuting shaft 11, 12. Each cutting disc 111, 112 has a total of eight comminuting cutting elements 110, 120 in the form of cutting teeth arranged uniformly in the peripheral direction.

On the side of the first comminuting shaft 11, the first screening device 30 is configured with a first screening wall 31 which has a curved surface. Similarly to this, on the part of the second comminuting shaft 12, the second screening device 40 is configured with a second screening wall 41 which has a curved surface. The curvature of the first screening wall 31 and the curvature of the second screening wall 41 are mirror-symmetrical with a center plane B. A clearing device 50, 60 is configured in each case in the through-flow direction C behind the screening devices 30, 40. The clearing devices 50, 60 each have an axial longitudinal bore 123, 124 which is used to enable the respective clearing device 50, 60 to be slipped onto the respective clearing shaft. Each clearing device 50, 60 has, as described above, a total of three clearing rakes 52*a-c*, 62*a-c*. The embodiment of the curvature of the clearing rakes in the first clearing device 50 in the opposite direction to the curvature of the clearing rakes of the second clearing device 60 means that a removal of foreign substances in the direction of the first comminuting shaft 11 and the second comminuting shaft 12 is guaranteed.

The direction of rotation of the comminuting shafts and the clearing shaft base body is denoted by arrows D, E, F, G in FIG. 4*b*.

The invention claimed is:

1. A comminuting device for solids-conducting liquids comprising:

a housing with an inlet opening, an outlet opening, and a housing interior extending from the inlet opening to the outlet opening;

a first comminuting shaft extending through the housing interior and arranged to rotate about a first comminuting axis and onto which a plurality of first comminuting cutting elements spaced apart axially along the first comminuting axis is fastened;

a second comminuting shaft extending through the housing interior and arranged to rotate about a second comminuting axis and onto which a plurality of second comminuting cutting elements spaced apart axially along the second comminuting axis is fastened;

a drive device for driving the first and second comminuting cutting shafts in a rotational movement;

a screening device having a screening wall comprising a plurality of slots arranged in the housing interior adjacent to the first comminuting shaft; and a clearing device comprising a plurality of clearing elements which can be moved relative to the screening wall along a movement path and which extend through the plurality of slots starting from a clearing shaft arranged on one side of the screening wall to at least one portion of the movement path;

wherein the clearing elements comprise a plurality of curved clearing fingers; and wherein the curvature of the curved clearing fingers forms a convex front side, wherein the convex front side runs ahead of a rear side of the curved clearing fingers in relation to the movement of the clearing elements in a direction of the movement path.

2. The comminuting device as claimed in claim 1, wherein a clearing drive device is coupled to the clearing shaft and sets the clearing shaft in rotation.

3. The comminuting device as claimed in claim 2, wherein the clearing drive device comprises hydrodynamically acting fluid-conducting elements arranged in the housing interior and flowed through by the liquid flow passing through the housing interior.

4. The comminuting device as claimed in claim 2, wherein the clearing drive device comprises an electrically, pneumatically or hydraulically driven motor.

5. The comminuting device as claimed in claim 1, wherein the first and second comminuting shafts extend between the screening device and a second screening device with a second screening wall comprising a second plurality of slots and a second clearing device with a plurality of clearing elements which extend through the second plurality of slots starting from a second clearing shaft arranged on one side of the second screening wall.

6. The comminuting device as claimed in claim 5, wherein the second clearing shaft is set in rotation by the clearing drive device.

7. The comminuting device as claimed in claim 5, wherein the second clearing shaft is coupled to a second clearing drive device, the second clearing drive device comprising hydrodynamically acting fluid-conducting elements arranged in the housing interior and flowed through by the liquid flow passing through the housing interior.

8. The comminuting device as claimed in claim 5, wherein the second clearing shaft is coupled to a second clearing drive device, the second clearing drive device comprising an electrically, pneumatically or hydraulically driven motor.

9. The comminuting device as claimed in claim 1, wherein the axial space between two axially adjacent first comminuting elements is of a size at least between the same size and ten times as large as a ball passage of the slots.

10. The comminuting device as claimed in claim 1, wherein the first and second comminuting shafts are driven in rotational directions opposing one another and the first and second comminuting axis run parallel to and are spaced apart from one another.

11. The comminuting device as claimed in claim 1, wherein a curvature of the curved clearing fingers forms a concave rear side of each curved clearing finger.

12. The comminuting device as claimed in claim 1, wherein the clearing elements are configured for a rotational movement about a spatial axis.

13. The comminuting device as claimed in claim 1, wherein the screening wall has a curved screening wall surface defining a cylindrical surface about the clearing axis in at least one portion of the screening wall.

14. The comminuting device as claimed in claim 1, wherein the clearing elements comprise a plurality of clearing rakes with a plurality of clearing elements and the clearing rakes are fastened about a clearing shaft base body extending along a clearing axis.

15. The comminuting device as claimed in claim 14, wherein at least two of the clearing rakes are fastened to the clearing shaft base body in such a manner that the clearing elements of a first clearing rake extend at an angle to the clearing rakes of a second first clearing rake.

16. The comminuting device as claimed in the claim 15, wherein a number N of clearing rakes are fastened to the clearing shaft base body and at least two of the clearing rakes in each case are oriented at an angle of 360°/N to one another.

17. A comminuting device for solids-conducting liquids comprising:

a housing with an inlet opening, an outlet opening and a housing interior extending from the inlet opening to the outlet opening;

a first comminuting shaft extending through the housing interior and arranged to rotate about a first comminuting axis and onto which a plurality of first comminuting cutting elements spaced apart axially along the first comminuting axis is fastened;

a second comminuting shaft extending through the housing interior and arranged to rotate about a second comminuting axis and onto which a plurality of second comminuting cutting elements spaced apart axially along the second comminuting axis is fastened;

a drive device for driving the first and second comminuting cutting shafts in a rotational movement;

a screening device having a screening wall comprising a plurality of slots arranged in the housing interior adjacent to the first comminuting shaft; and a clearing device comprising a plurality of clearing elements which can be moved relative to the screening wall along a movement path and which extend through the plurality of slots starting from a clearing shaft arranged on one side of the screening wall to at least one portion of the movement path, wherein the plurality of clearing elements are fastened to a clearing shaft basic body and at least two of the plurality of clearing elements extend at a different angle from one another from the clearing shaft base body.

18. The comminuting device as claimed in the claim 17, wherein all clearing elements extend at a different angle from one another from the clearing shaft base body.

19. A comminuting device for solids-conducting liquids comprising:

a housing with an inlet opening, an outlet opening and a housing interior extending from the inlet opening to the outlet opening;

a first comminuting shaft extending through the housing interior and arranged to rotate about a first comminuting axis and onto which a plurality of first comminuting cutting elements spaced apart axially along the first comminuting axis is fastened;

a second comminuting shaft extending through the housing interior and arranged to rotate about a second comminuting axis and onto which a plurality of second comminuting cutting elements spaced apart axially along the second comminuting axis is fastened, wherein the first and second comminuting shafts extend between a first screening device;

a drive device for driving the first and second comminuting shafts in a rotational movement;

the first screening device having a first screening wall comprising a first plurality of slots arranged in the housing interior adjacent to the first comminuting shaft;

a first clearing device comprising a plurality of first clearing elements which can be moved relative to the first screening wall along a movement path and which extend through the first plurality of slots starting from a first clearing shaft arranged on one side of the first screening wall to at least one portion of the movement path; and a second screening device with a second screening wall comprising a second plurality of slots and a second clearing device with a plurality of second clearing elements which extend through the second plurality of slots starting from a second clearing shaft arranged on one side of the second screening wall.

20. A comminuting device for solids-conducting liquids comprising:

a housing with an inlet opening, an outlet opening, and a housing interior extending from the inlet opening to the outlet opening;

a first comminuting shaft extending through the housing interior and arranged to rotate about a first comminuting axis and onto which a plurality of first comminuting cutting elements spaced apart axially along the first comminuting axis is fastened;

a second comminuting shaft extending through the housing interior and arranged to rotate about a second comminuting axis and onto which a plurality of second comminuting cutting elements spaced apart axially along the second comminuting axis is fastened;

a drive device for driving the first and second comminuting cutting shafts in a rotational movement;

a screening device having a screening wall comprising a plurality of slots arranged in the housing interior adjacent to the first comminuting shaft; and a clearing device comprising a plurality of clearing elements which can be moved relative to the screening wall along a movement path and which extend through the plurality of slots starting from a clearing shaft arranged on one side of the screening wall to at least one portion of the movement path;

wherein the first and second comminuting shafts extend between the screening device and a second screening device with a second screening wall comprising a second plurality of slots and a second clearing device with a plurality of clearing elements which extend through the second plurality of slots starting from a second clearing shaft arranged on one side of the second screening wall.

21. The comminuting device as claimed in claim 20, wherein the second clearing shaft is set in rotation by the clearing drive device.

22. The comminuting device as claimed in claim 20, wherein the second clearing shaft is coupled to a second clearing drive device, the second clearing drive device comprising hydrodynamically acting fluid-conducting elements arranged in the housing interior and flowed through by the liquid flow passing through the housing interior.

23. The comminuting device as claimed in claim 20, wherein the second clearing shaft is coupled to a second clearing drive device, the second clearing drive device comprising an electrically, pneumatically, or hydraulically driven motor.

24. A comminuting device for solids-conducting liquids comprising:

a housing with an inlet opening, an outlet opening, and a housing interior extending from the inlet opening to the outlet opening;

a first comminuting shaft extending through the housing interior and arranged to rotate about a first comminuting axis and onto which a plurality of first comminuting cutting elements spaced apart axially along the first comminuting axis is fastened;

a second comminuting shaft extending through the housing interior and arranged to rotate about a second comminuting axis and onto which a plurality of second comminuting cutting elements spaced apart axially along the second comminuting axis is fastened;

a drive device for driving the first and second comminuting cutting shafts in a rotational movement;

a screening device having a screening wall comprising a plurality of slots arranged in the housing interior adjacent to the first comminuting shaft; and a clearing device comprising a plurality of clearing elements which can be moved relative to the screening wall along a movement path and which extend through the plurality of slots starting from a clearing shaft arranged on one side of the screening wall to at least one portion of the movement path;

wherein the clearing elements comprise a plurality of clearing rakes with a plurality of clearing elements and the clearing rakes are fastened about a clearing shaft base body extending along a clearing axis; and wherein at least two of the clearing rakes are fastened to the clearing shaft base body in such a manner that the clearing elements of a first clearing rake extend at an angle to the clearing elements of a second clearing rake.

25. The comminuting device as claimed in the claim 24, wherein a number N of clearing rakes are fastened to the clearing shaft base body and at least two of the clearing rakes in each case are oriented at an angle of 360°/N to one another.

* * * * *